United States Patent [19]

Auer

[11] Patent Number: 4,577,809

[45] Date of Patent: Mar. 25, 1986

[54] GATHERING AND STORING DEVICE FOR ELECTRIC CABLE

[76] Inventor: William F. Auer, 1654 Walnut, DesPlaines, Ill. 60016

[21] Appl. No.: 706,197

[22] Filed: Feb. 27, 1985

[51] Int. Cl.[4] ..... B65H 75/40

[52] U.S. Cl. ..... 242/96; 242/106; 242/151; 191/12.2 R

[58] Field of Search ..... 242/96, 106, 85, 100, 242/86, 75.2, 151, 152; 191/12.2 R, 12.4

[56] References Cited

U.S. PATENT DOCUMENTS

| | | | |
|---|---|---|---|
| 1,718,777 | 6/1929 | Choinski | 242/96 |
| 2,414,169 | 1/1947 | Raymond | 242/96 |
| 2,815,181 | 12/1957 | Dickinson | 242/96 |
| 3,106,367 | 10/1963 | Stahmer | 242/96 |
| 3,880,378 | 4/1975 | Ballenger | 242/96 |
| 3,997,095 | 12/1976 | Lamb | 242/75.2 X |
| 4,442,984 | 4/1984 | Bayat | 242/106 |

FOREIGN PATENT DOCUMENTS

| | | | |
|---|---|---|---|
| 4583 | of 1898 | United Kingdom | 242/96 |

*Primary Examiner*—John M. Jillions
*Attorney, Agent, or Firm*—Conlon & Kerstein

[57] ABSTRACT

A gathering and storing device for electric extension cords and comprising a frame providing a handle member at the upper end to be grasped by the user and a foot bar to be located on the ground and stood on by the user to stabilize the cord gathering device during use. A rotatable reel has a handle which is rotated to gather the cord. A slack adjuster is located adjacent the handle and includes a pressure plate to which the user's fingers are applied to provide a slight pressure to insure that the cord is gathered onto the reel in a neat and orderly fashion. The pressure plate has finger members which guide the cord and prevent it from slipping off the pressure plate. A locking ring is attached about the frame and can be placed about a portion of the reel to insure the reel does not move during storage. One side of the reel has lead clips and a plug holder clip to allow a short portion of the cord near the plug to be gathered on the outside of the reel in order that it can be easily disengaged to be plugged in a outlet.

6 Claims, 3 Drawing Figures

GATHERING AND STORING DEVICE FOR ELECTRIC CABLE

FIELD OF THE INVENTION

This disclosure pertains to cord gathering and storage devices and in particular to those devices having a ground mounted stabilizing foot, a rotatable reel member, a handle, and, means for providing tension to the cord as it is being gathered to insure that the cord is gathered on the reel in a tight fashion.

DESCRIPTION OF THE PRIOR ART

Prior art reel gathering devices have generally come in two forms. One form is a solid piece of plastic or wood having some form of handle and is operated by the user to gather up a cord by the user holding the gathering device in one hand and winding the cord with the other hand. These devices have met with some acceptance because they are inexpensive and certainly better than having the user merely gather a cord and wrapping on his/her arm and around itself for storage. These simple devices provide for an orderly gathering and storage of extension cords. However, they are cumbersome to use and not particularly efficient for quickly gathering and storing an extension cord.

Another type of cord gathering device is the reel type of gathering device which provides a housing with internal or external spool that is either connected with a spring to automatically rotate a cord or connected with a external handle to allow the spool to be rotated and the cord gathered. One draw back with this type of device is that the length of the cord is generally restricted to the size of the spool which is provided. There are no known large capacity gathering and storing devices for yard type extension cords which are used for operating electric grass cutting machines, hedge cutters, snow blowers, and, outdoor tools such as drills, handsaws and the like.

Problems with the prior art device such as inconvenience of operation and low capacity cord storage have been eliminated with the instant disclosure. The reel gathering and storing device disclosed is easily operated by one individual and has a high capacity allowing the device to store 100 or more feet of extension cords which are common around the house.

SUMMARY

This disclosure pertains to a hand held, portable gathering and storing device for electric extension cords. A frame member supports a reel and provides a handle and foot bar which allows the cord holder to be easily positioned by the user for gathering or extending an electric cord. As the cord is wound on to the reel, a slack adjuster pressure plate captures the cord and is contacted by the user's fingers to provide tension to the cord to insure that it is neatly gathered on to the reel. The slack adjuster has guide fingers at the sides to insure that the cord does not come free as it is being wound onto the reel. Once the cord is gathered, a locking ring interconnects the frame and reel to insure that the reel does not move inadvertently during transport or storage. The reel is located far enough above the foot to insure that as the reel is turned it will not come into contact with the ground, mud, snow and the like. One side of the reel includes a pair of lead clips and a plug holder clip to allow a short portion of the cord next to the male plug to be easily stored and easily loosened in order that it can be plugged in to a source of electricity.

It is thus an object of this disclosure to provide a cord holder which can be easily operated by one individual and stabilized by hand and foot pressure and easily operated to gather and extend an electrical cord.

It is another object of this disclosure to provide a reel gathering device having a cord slack adjuster for tensioning the cord as it is gathered onto the reel to insure that it is gathered in a neat and efficient manner.

It is another object of this disclosure to provide a cord holder having a rotatable reel that has means for storing a short length of cord adjacent to the plug away from the main storage portion where the extension cord is gathered to allow the end to be easily loosened from the reel and plugged into a source of electric current.

Another object of this disclosure is to provide a cord holder having a frame with a recess in the handle to allow the device to be easily stored on a nail, peg or the like without falling off.

These and other objects of this disclosure will be become apparent to those having ordinary skill in the art with reference to the following description, drawings, and claims.

DESCRIPTION OF THE PREFERED EMBODIMENT

Figure 2:
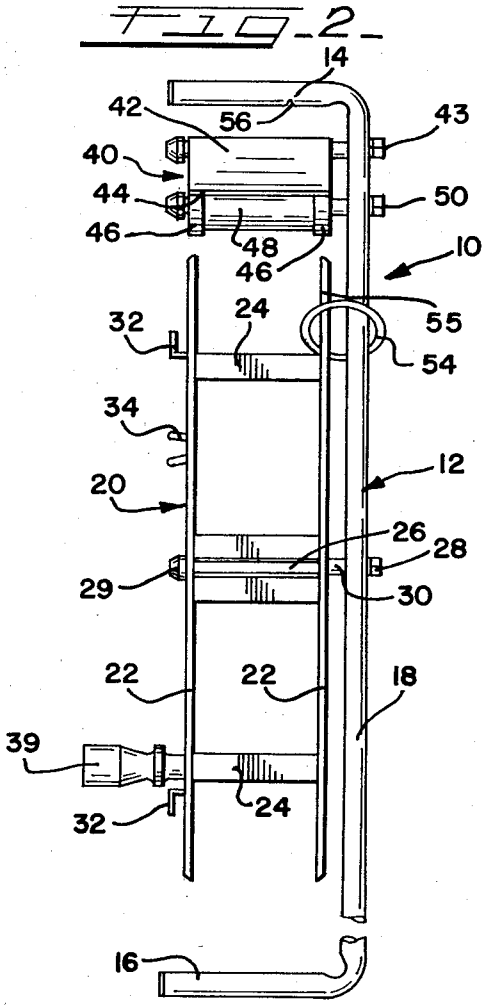
FIG. 2 is an elevation view of the device.
Figure 1:
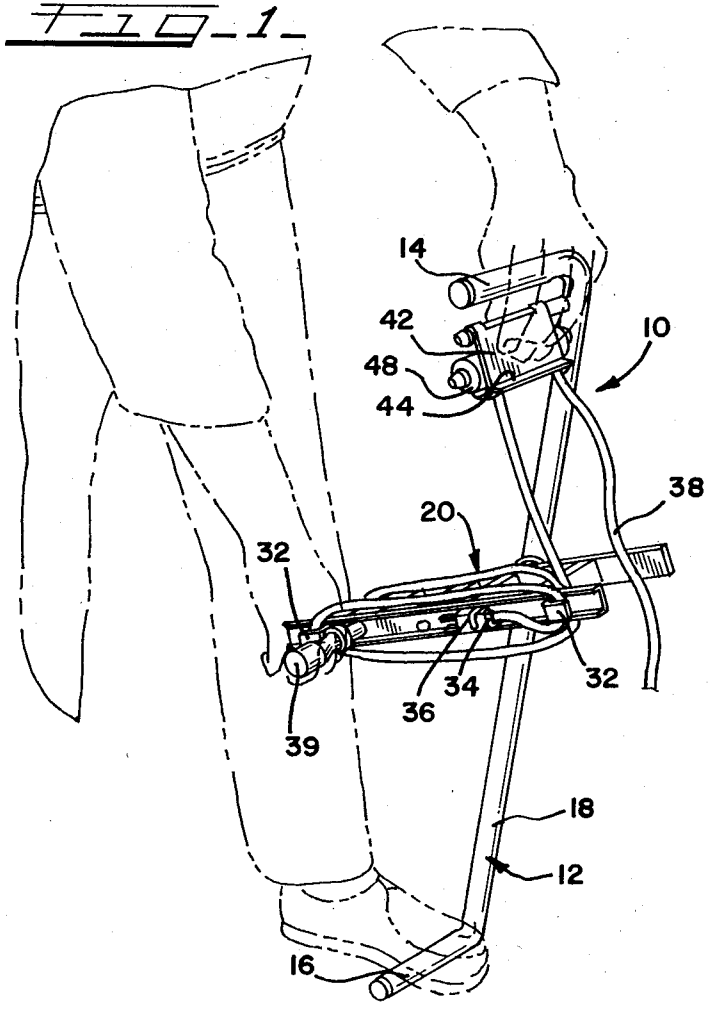
FIG. 1 is a pictorial illustration of the cord gathering device in operation gathering an electrical extension cord.

Referring to the drawings, FIG. 1 shows the device as it would be used with the individual operator shown in phantom. The cord holder 10 includes a tubular frame 12 having a handle 14 and a foot bar 16 which is adapted to rest on the ground and be held in place by the user's shoe. In such a position the device is easily grasped and highly stable. A connector bar 18 extends between the handle 14 and the foot bar 16. As shown in FIG. 2 the foot bar can be L-shaped as shown in the solid lines or T-shaped as shown in the solid and dotted lines. It has been found that the connector bar 18 should be approximately three (3) feet long to provide a unit that easily handled by an average size person. Such human engineering factors are certainly to be considered in providing a product that can be easily used. However, it must be noted that the specific dimensions of this product are not inherent in the invention and various lengths of cord holders 10 could be utilized without departing from the scope of this invention.

A reel 20 is mounted for rotating movement at the center portion of the connector bar 18. The reel 20 has a pair of spaced sides 22 separated and connected by spacer bars 24. A pivot shaft 26 (FIG. 2) is secured to the connector bar 18 and held in place by the nuts 28, 29 and maintained in position by spacer bar 30 which positions the inside of the reel 20 a short distance from the connector bar 18. The outer side 22 has a pair of clips 32 attached thereto which allow the end of the cord 38 to be wound through the clips 32 with the plug 36 (FIG. 1) positioned adjacent the side 22 and held in place by an open clip 34 which is welded or otherwise attached to the side 22. A handle 39 is provided and has a contour which can be easily grasped by a user. It should be pointed out that the purpose for providing the clips 32 and the plug holder 34 is that by winding a short portion of the end of the extension cord 38 at the side of the reel it can be easily disconnected and plugged into a source of electrical current without completely unwinding the entire cord. Otherwise the cord would be wound around the reel and inconvenient to remove and plug in. It should also be noted that the reel 20 is not attached at the middle of bar 18 (FIG. 1) but is closer to the handle 14. This spacing provides increased clearance between the cord as it is hung gathered and stored and the ground to thus keep the cord fee of mud, snow and the like.

Figure 3:
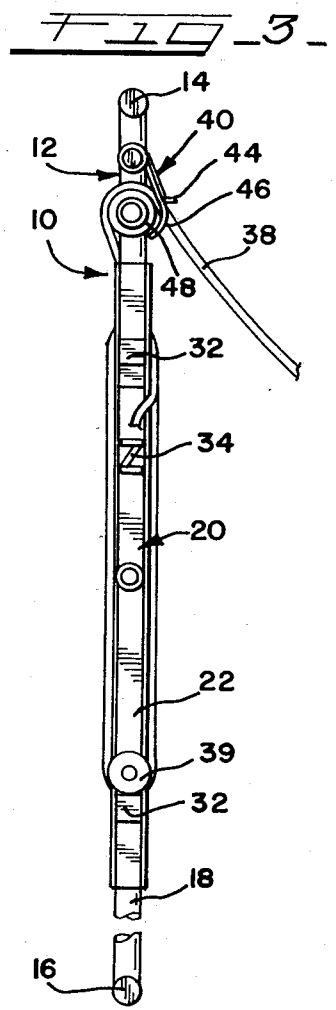
FIG. 3 is a side view of the device illustrated in FIG. 2.

The top portion of the frame 12 has a slack adjuster 40 which is designed to contact the cord 38 as it is being gathered and provide a slight amount of tension which controls the cord and also insures that it is neatly and compactly wound about the reel 20. This so-called slack adjuster 40 has a pressure plate 42 which can be contacted by the user's fingers as shown in FIG. 1 and urged towards a roller 48 to provide tension on the cord 38. The pressure plate is mounted for limited rotation and movement about a hinge pin 43 which can be held in position by any convenient device such as by using nuts and a spacer similar to those 28, 30 which hold the reel 20 in position. The specifics of the mechanical attachment arrangement are not critical to the operation of the slack adjuster. As shown in FIG. 3, the slack adjuster 40 has a lip 44 which provides a rounded edge for contacting the cord 38 and insures that the cord is not nicked, scratched or otherwise damaged as it is being gathered. On each lateral end of the pressure plate 42 a pair of fingers 46 are positioned which extend downwardly from the lip 44 and follow the contour of the roller 48. These fingers 46 guide the cord 38 as it is being gathered and ihsures that it stays within the confines of the roller 48 in order to be easily gathered onto the reel 20. The tension roller 48 is located just below the slack adjuster 40 and also connected with the bar 18 by any convenient type of mechanical fastener arrangement.

A locking ring 54 is located about the bar 18 and can be used to fit over the top extension 55 of the inner side 22 to prevent movement of the reel when the cord holder is being transported or stored.

In operation it is recommended that the device be positioned as shown in FIG. 1 next to the user. The user's foot is placed on the foot bar 16 and the device is angled slightly upwardly and outwardly from the user to allow the reel 20 to be rotated freely of the user's body for gathering the extension cord 38. For example, if the user's left hand grasps the handle 14 the person's right hand can engage the operating handle 39 to rotate the reel 20 to gather the cord 38. The cord 38 is fitted about the tension roller 48 in such a fashion that the loose end of the cord is between the roller 48 and the pressure plate 42 in order that the free end of the extension cord can be guided by the guide fingers 46 as the reel 20 is rotated. It also should be pointed out that prior to gathering the extension cord 38 the plug end of the extension cord should be wound about the lead clips 32, and, a portion of the cord 38 adjacent the plug 36 should be restrained in the plug holder clips 34 as shown in FIG. 1.

When gathering a cord the user holds handle 14 and with the end of his or her fingers contacts the pressure plate to apply tension to the cord to insure that it is tightly wound about the reel 20. After the cord is completely gathered, the loose end is merely tucked under one of the wraps of cord and the locking ring 54 brought into the position shown in FIG. 2 to restrain movement of the reel 20. The cord holder 10 can be conveniently carried to another area of use or put into storage.

A dimple or recess 56 is provided on the under side of the handle 14 to allow the device to be stored on a nail peg, peg or the like without movement. It is noticed that the dimple 56 is slightly off center. This allows the cord holder 10 to be stored in an upright position because the center of gravity is not in the center of the reel 20 but is at a point where the dimple 56 is located.

Thus it has been shown by the foregoing that a simple reliable and easily operated device for gathering and storing long type extension cords or industrial extension cords as provided. A lengthy cord can be easily gathered by a single person in a very short time and neatly and rapidly wound around the reel 20. It is contemplated that the handle 14 or the foot bar 16 could be T-shaped and shown on the dotted lines of the illustrations (FIG. 2) in order to enable the user to grasp either side of the device.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

I claim:

1. A portable, manually operated cord gathering and storage device for an extension cord and the improvement comprising:

a frame member providing a handle to be grasped by a user;

a reel rotatably mounted on the frame member below said handle and also including a grasping portion for rotating the reel to gather and store said extension cord;

a slack adjuster with manually operated means aligned with the reel as it rotates cooperating with an associated tension roller to contact said extension cord and apply tension as the cord moves from the roller and is being gathered on the reel;

said manually operated means of said slack adjuster including a pressure plate with a hand engaging portion and also including a cord engaging lip; and guide means operating in conjunction with the slack adjuster to insure proper positioning of the cord on said reel.

2. The cord gathering and storing device of claim 1 and:

said cord holder also including locking means for preventing movement of the reel after the extension cord is gathered.

3. The cord holder of claim 1 and further including:

a foot bar located at the lower portion of said frame member and extending outwardly therefrom to be positioned on the ground and held in place by the user's foot.

4. The cord holder of claim 1 and said reel further including:

clip means for gathering and accumulating an end portion of said extension cord and further including plug holder clip means for restraining and holding the free end portion of said extension cord to prevent its inadvertent movement yet allow the end portion to be easily removed from the reel to be connected with a source of electrical energy after the extension cord is unwound from the reel for use.

5. The cord holder of claim 1 wherein said slack adjuster includes;

guide fingers extending downwardly therefrom for restraining movement of said extension cord as it is being gathered on the reel and thus insuring that the extension cord maintains a captured position under the slack adjuster allowing the user to apply pressure to the gathered cord and tension it for placement on said reel.

6. The cord gathering and storing device of claim 1, and:

a foot bar at the distal portion of the frame away from said handle;

said foot bar comprising a pair of lateral extensions adapted to be stepped upon by the user to stabilize said cord gathering and storing device.

* * * * *